US012227903B2

(12) United States Patent
Buchberger

(10) Patent No.: US 12,227,903 B2
(45) Date of Patent: Feb. 18, 2025

(54) SWEEPING DEVICE FOR WORKING ON A TRACK SYSTEM

(71) Applicant: PLASSER & THEURER EXPORT VON BAHNBAUMASCHINEN GESELLSCHAFT M.B.H., Vienna (AT)

(72) Inventor: Guenther Buchberger, Bad Hall (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 237 days.

(21) Appl. No.: 17/790,235

(22) PCT Filed: Dec. 17, 2020

(86) PCT No.: PCT/EP2020/086635
§ 371 (c)(1),
(2) Date: Jun. 30, 2022

(87) PCT Pub. No.: WO2021/136672
PCT Pub. Date: Jul. 8, 2021

(65) Prior Publication Data

US 2023/0031915 A1 Feb. 2, 2023

(30) Foreign Application Priority Data

Dec. 30, 2019 (AT) ..... A 410/2019

(51) Int. Cl.
*E01H 1/04* (2006.01)
*E01B 27/02* (2006.01)
(Continued)

(52) U.S. Cl.
CPC ..... *E01B 27/026* (2013.01); *E01B 27/025* (2013.01); *E01H 1/04* (2013.01); *A47L 11/24* (2013.01); *E01H 1/08* (2013.01)

(58) Field of Classification Search
CPC ... E01H 1/08; E01H 1/05; A47L 11/24; A47L 11/4013; E01B 27/025
See application file for complete search history.

(56) References Cited

U.S. PATENT DOCUMENTS 3,007,264 A 11/1961 Stanton
4,214,338 A * 7/1980 Kyle ..... E01H 1/04 15/83
(Continued)

FOREIGN PATENT DOCUMENTS

AT 395875 B 3/1993
CN 205822116 U 12/2016
(Continued)

*Primary Examiner* — Michael D Jennings
(74) *Attorney, Agent, or Firm* — Laurence A. Greenberg; Werner H. Stemer; Ralph E. Locher

(57) ABSTRACT

A sweeping device works on a track formed of rails and sleepers. The sweeping device has a brush shaft formed from a plurality of shaft portions configured as hollow shafts, and resilient sweeping elements protruding radially from the brush shaft. The sweeping device can be attached via at least one adjustable vertical drive to a vehicle that can travel on rails. It is provided that at least one axis of rotation of a shaft portion is adjustable via a control shaft with control elements acting externally on the shaft portion.

10 Claims, 3 Drawing Sheets

(51) Int. Cl.
*A47L 11/24* (2006.01)
*E01H 1/08* (2006.01)

(56) References Cited

U.S. PATENT DOCUMENTS

| | | | | | |
|---|---|---|---|---|---|
| 5,060,334 | A * | 10/1991 | Strauser | B60G 17/0523 15/84 |
| 5,076,367 | A | 12/1991 | Reincke | |
| 9,783,942 | B1 * | 10/2017 | Stell | E01H 1/04 |
| 10,508,395 | B1 * | 12/2019 | Madden | E01H 1/042 |
| 2008/0235897 | A1 * | 10/2008 | Kim | A47L 11/4013 901/1 |

FOREIGN PATENT DOCUMENTS

| | | | | |
|---|---|---|---|---|
| EP | 0164163 | A2 | 12/1985 | |
| EP | 2016814 | A1 | 1/2009 | |
| EP | 2182115 | A1 | 5/2010 | |
| EP | 2775035 | A2 | 9/2014 | |
| GB | 116429 | A | 6/1918 | |
| GB | 2024583 | A | 1/1980 | |
| NL | 7807270 | A | 1/1980 | |
| WO | WO-9202689 | A1 * | 2/1992 | |
| WO | WO-2009044055 | A2 * | 4/2009 | A01G 1/125 |

* cited by examiner

SWEEPING DEVICE FOR WORKING ON A TRACK SYSTEM

FIELD AND BACKGROUND OF THE INVENTION

The invention relates to a sweeping device for working on a track formed of rails and sleepers, with a brush shaft consisting of a plurality of shaft portions, which is designed as a hollow shaft, having resilient sweeping elements protruding radially from it, which can be attached via at least one adjustable vertical drive to a vehicle that can travel on rails.

The ballast bed secures the track geometry against track buckling. Essential for this is the technically correct design of the ballast bed cross-section. This means that sufficient quantities of ballast are distributed as uniformly as possible and in the defined profile along the entire course of the line. In order to be able to carry out tamping in a durable manner, there must be sufficient ballast.

The ballast is removed by corresponding ballast ploughs. The ballast shoulder is profiled using shoulder ploughs, which ensures that the correct angle of the embankment is produced. The shoulder ploughs draw the ballast into the upper area of the ballast bed towards the ballast crown. There the crown plough takes up the ballast and distributes it in the track area according to the position of the baffle plates.

Finally, a sweeping unit removes residual ballast stones from the sleeper surfaces. Often, sweeping units are equipped with a transverse conveyor belt, which then either discharges excess ballast to the side or conveys it via another conveyor belt into a storage hopper. In the case of high-speed lines, the sweeping units are of particular importance; this is referred to as deep sweeping.

In this process, the ballast in the middle of the sleeper cribs, which is the area between two adjacent sleepers, is swept deeper than the sleeper surface.

A sweeping device with a total of five arranged sweeping brushes distributed over the track cross-section is known from U.S. Pat. No. 3,007,264. The brush shafts of the two outer sweeping brushes, each intended for sweeping a ballast shoulder, are connected to the brush shafts of the respective adjacent sweeping brushes via a cardan joint and can thus be adjusted at an angle to them, while all five sweeping brushes can be made to rotate via a common drive.

Furthermore, AT 395 875 B discloses a track maintenance machine for working on the ballast bed of a track. With a device for clearing or sweeping ballast and, if necessary, further devices intended for ballast storage and/or introduction into the track or ballast profiling, the ballast sweeping device arranged in the sleeper area consisting of three sweeping rollers which are vertically adjustable and can be rotated independently of one another by drives, are arranged one behind the other in the transverse direction of the machine and whose axes of rotation run essentially in the transverse direction of the machine. The total of three sweeping rollers only extend over the entire sleeper area, and the axes of rotation of the two outer sweeping rollers can be adjusted independently of each other in the angle to the axis of rotation of the central sweeping roller or to the track plane.

Based on this, EP 2 775 035 B1 shows a sweeping device with improved application possibilities and an adjustment option, which is implemented by a control shaft guided inside the hollow shaft with an eccentrically designed bearing.

SUMMARY OF THE INVENTION

The object of the invention is to provide a device of the kind mentioned above with greater flexibility in adapting to different sleeper shapes, as well as an increase in sweeping performance and thus the cost efficiency of the machine, with a concomitant improvement in the quality of the sweeping pattern compared to prior art.

According to the invention, these objects are achieved by way of a device according to the independent device claim. Dependent claims refer to advantageous embodiments of the invention.

The invention provides that at least one axis of rotation of a shaft portion is adjustable via a control shaft with control elements acting externally on the shaft portion.

This eliminates the need for a complex shaft-in-shaft set-up, in which the control shaft is designed inside the brush shaft with an internal, eccentrically designed bearing, which is responsible for the inclination of the brush shaft. This also makes the production and assembly of the components at the factory much easier. Expensive special tools or even a complex, separable shaft design are thus superfluous.

It is advantageous if the control elements are joined to the rotatably mounted control shaft and are designed in a sword-like shape.

The slim design and especially the position of the control elements is chosen accordingly so that there is no contact with sweeping elements. Unwanted wear of the sweeping elements can thus be prevented.

One embodiment of the invention provides that the control shaft is rotated via a mechanical linkage and at least one gear.

Via a corresponding linkage mechanism, a gear is actuated by a translatorily acting actuator, which adjusts the control shaft around its axis of rotation. The gear converts the translatory actuation movement into a rotatory degree of freedom that drives the control shaft. The actuator is designed as a double-acting hydraulic cylinder, supplied via the existing, on-board hydraulic system. This makes it easy to actuate and regulate. An internally mounted position/displacement measuring system can also be used to determine the position of the piston.

It is particularly advantageous if the gear is designed as a worm gear.

Implementation as a self-locking worm gear is evidence of high process stability and reliability in the actuation of the control shaft and thus of the intervening positioning elements.

A further embodiment of the invention provides that the individual shaft portions of the brush shaft are movably connected via cardan joints.

This guarantees a robust, positive power transmission with simultaneous axial longitudinal compensation, which is required for adjustment of the multi-part brush shaft.

One embodiment provides that the brush shaft is driven by means of at least one laterally arranged chain drive.

This arrangement allows for a slim design of the structural shaft suspension. The drive sprocket is rotated by an internally flanged hydraulic motor.

It is particularly advantageous if the brush shaft consists of five shaft portions.

A five-part hollow shaft design ensures optimum adaptability to almost all common sleeper shapes, especially concrete sleepers with partially sloping surfaces. This design also completely covers the middle of the sleeper, leaving no undesirable ballast accumulation. This area is of particular importance in high-speed traffic, where the ballast in the middle of the sleeper cribs must be swept more deeply than the sleeper surface in the case of so-called deep sweeping.

A useful further development of the invention is that two control elements act on the central part of the shaft portions, with one control element each acting on the bearing point on the left and right thereof.

The symmetrical engagement of the positioning elements on the central shaft portion of the brush shaft ensures uniform power transmission and counteracts possible jamming and signs of wear caused by asymmetrical loading.

A further embodiment provides that the brush shaft as well as the control shaft with their associated drive and bearing components are arranged in a common brush box.

This forms a compact unit and enables rapid assembly and disassembly of the entire device if required.

It is also possible that the sweeping elements, which are resilient and radially arranged on the brush shaft, are made of solid material or internally hollow, tubular products.

This provides a high degree of flexibility in adapting to the condition and grain size of the loose material. Different sleeper shapes may also require a corresponding shape and design of the sweeping elements.

Furthermore, the design is characterised by a larger diameter of the hollow shaft and consequently a larger shaft circumference. This results in the accommodation of more sweeping elements compared to previous machines. Consequently, this achieves a higher sweeping performance with an even, clean sweeping pattern.

BRIEF DESCRIPTION OF THE FIGURES

In the following, the invention is explained by way of example with reference to the accompanying figures. The following figures show in schematic illustrations.

DETAILED DESCRIPTION OF THE INVENTION

Figure 1:
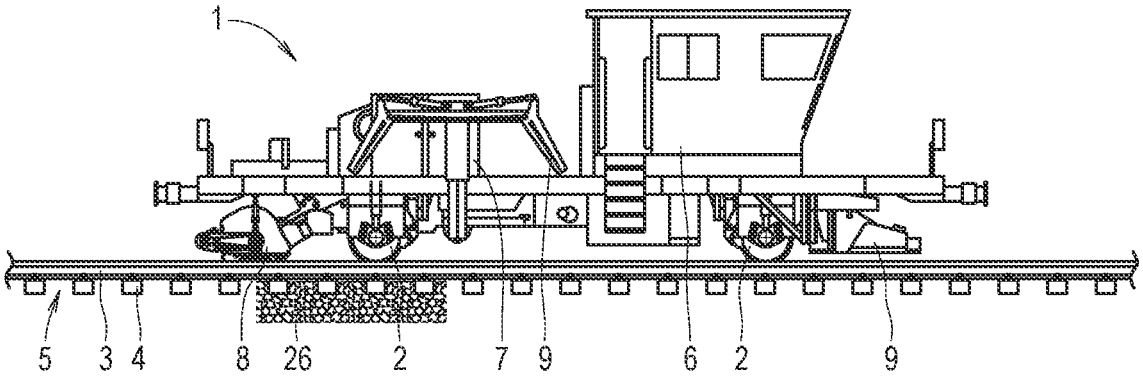
FIG. 1 Side view of a machine for working on a track system

FIG. 1 shows a simplified vehicle 1 for working on a track 5 formed of rails 3 and sleepers 4, which is movable on the track 5 by means of rail-based running gears 2. This comprises a drive and work cab 6, a drive unit 7, a sweeping device 8, and ploughs 9 for manipulating the ballast 26. The sweeping device 8 is attached to the vehicle via an adjustable vertical drive 23.

Figure 2:
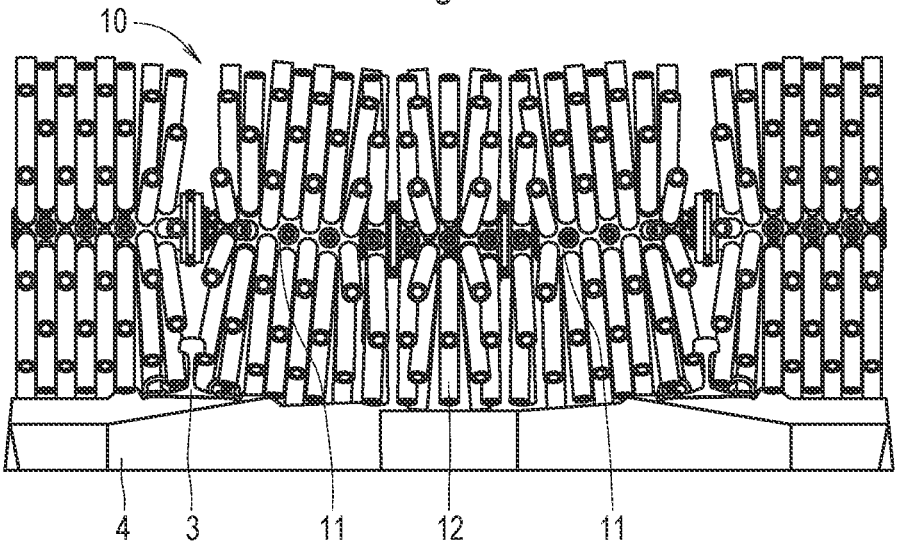
FIG. 2 View of a multi-part brush shaft with sweeping elements

FIG. 2 shows a view of a multi-part brush shaft 10 over a sleeper 4 with rails 3. In this embodiment, the brush shaft 10 consists of five shaft portions 11 (see also FIG. 5), which are designed as hollow shafts. Radially protruding from this, the sweeping elements 12 are made of resilient material, whereby these can be exchanged individually. The shaft portions 11 are joined together by cardan joints 13.

Figure 3:
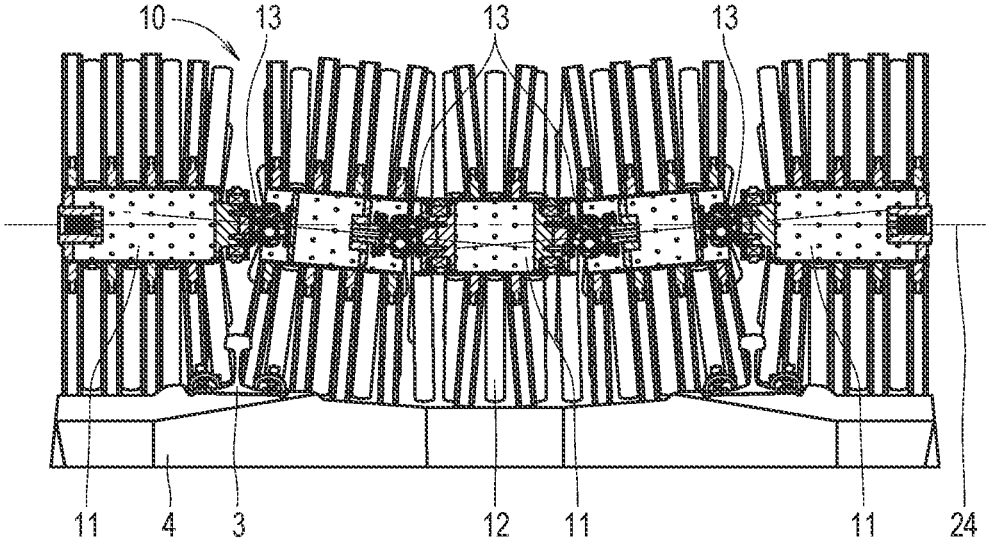
FIG. 3 Sectional view of a multi-part brush shaft with sweeping elements

The embodiment explained above for FIG. 2 is shown in FIG. 3 by means of a sectional view through the axis of rotation 24. The central part of the shaft portions 11 is designed to be vertically adjustable by two control elements 17; the control elements 17 act on the left and right in the area of the cardan joints 13. The arrangement is symmetrically designed; the two adjacent parts of the central shaft portion are therefore inclined by the same angle in terms of magnitude.

Figure 4:
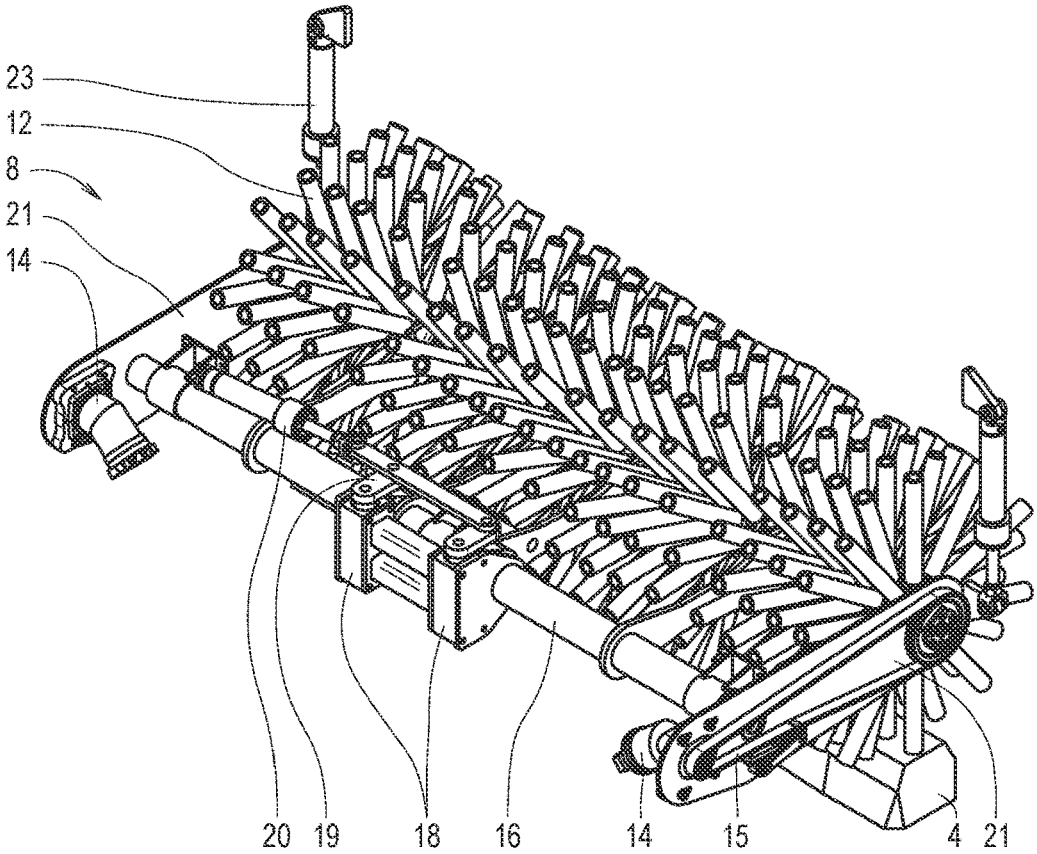
FIG. 4 Isometric drawing of a multi-part brush shaft with sweeping elements

FIG. 4 shows an isometric drawing of a multi-part brush shaft 10 with sweeping elements 12; the sweeping device is attached to the vehicle 1 via an adjustable vertical drive 23. The brush shaft is pressurised by means of two laterally arranged hydraulic drives 14 via chain drives 15. The control shaft 16 with the control elements 17 is mounted via the supporting frame 21 of the device 8. A gear is installed on the control shaft 16, designed as a double, self-locking worm gear 18. Actuation is carried out by a translatorily acting hydraulic cylinder 20, which is connected to the worm gears 18 via a mechanical linkage 19.

Figure 5:
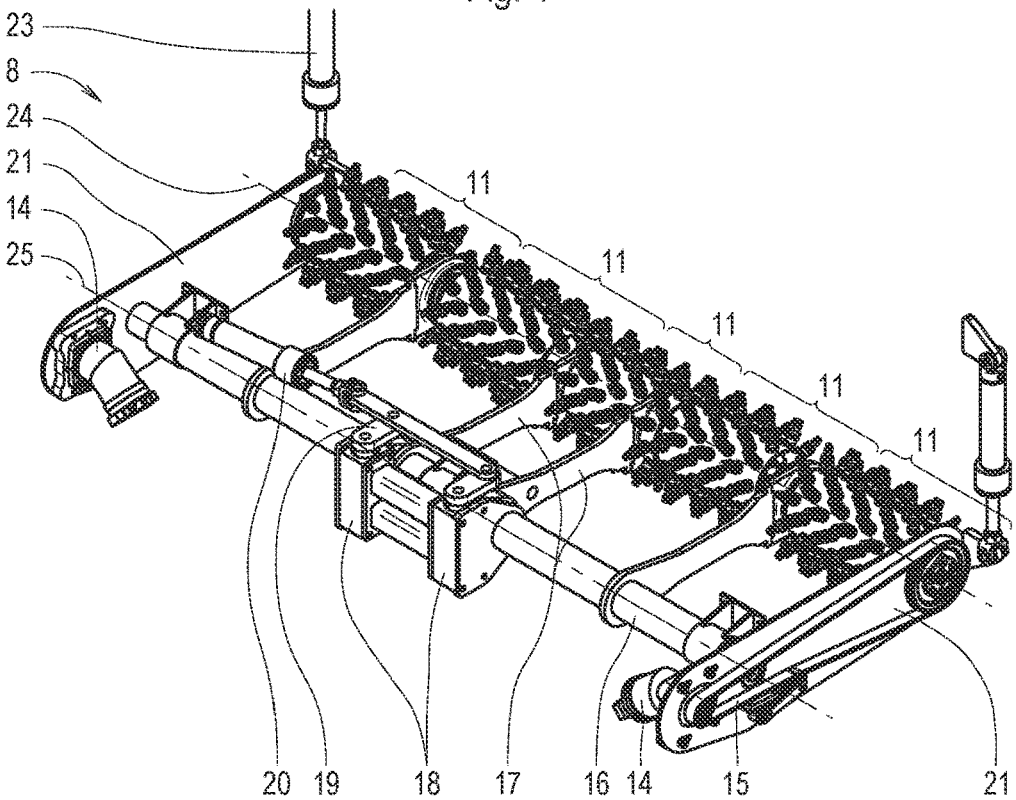
FIG. 5 Isometric drawing of a multi-part brush shaft without sweeping elements FIG. 6 Side view of a sweeping device with brush box FIG. 7 Isometric drawing of a sweeping device with brush box

FIG. 5 shows, as in FIG. 4, an isometric drawing of a multi-part brush shaft 10, but without sweeping elements 12, in order to clearly illustrate the entire set-up of the brush shaft 10 with the individual shaft portions 11 and, in particular, the engagement points of the control elements 17. The shaft portions 11 are connected by cardan joints 13. In the neutral, undeflected position of the control elements 17, the axis of rotation 24 of the shaft portions 11 is parallel to the axis of rotation 25 of the control shaft 16. The control shaft 16 is designed shaft-in-shaft, i.e. only the two central control elements 17, which act on the central shaft portion 11 directly adjacent to the left and right thereof, are designed to rotate. All other control elements 17 are rigidly joined to the outer profile of the control shaft 16.

Figure 6:
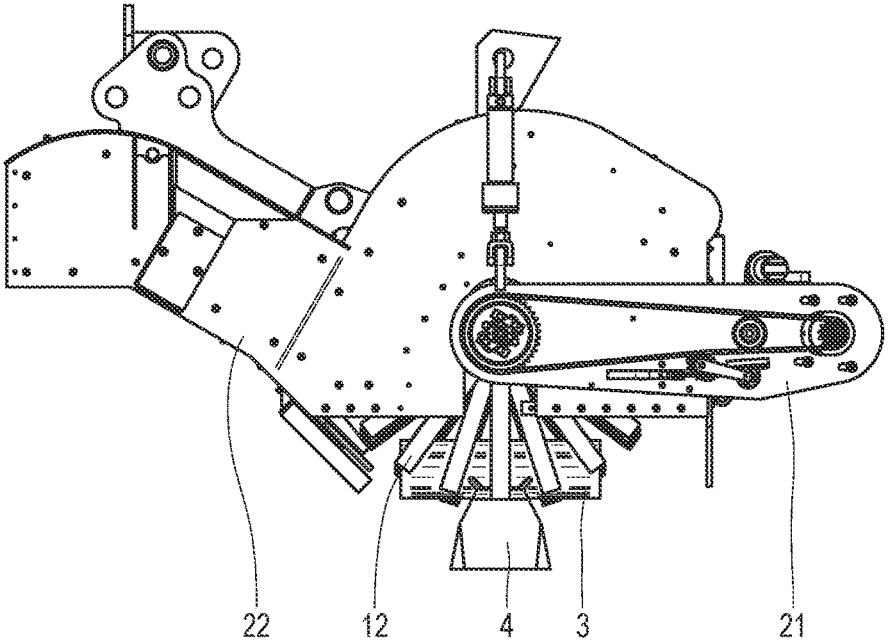

FIG. 6 shows a side view of the sweeping device 8 in the brush box 22.

The supporting frame 21 is directly connected to the brush box 22.

Figure 7:
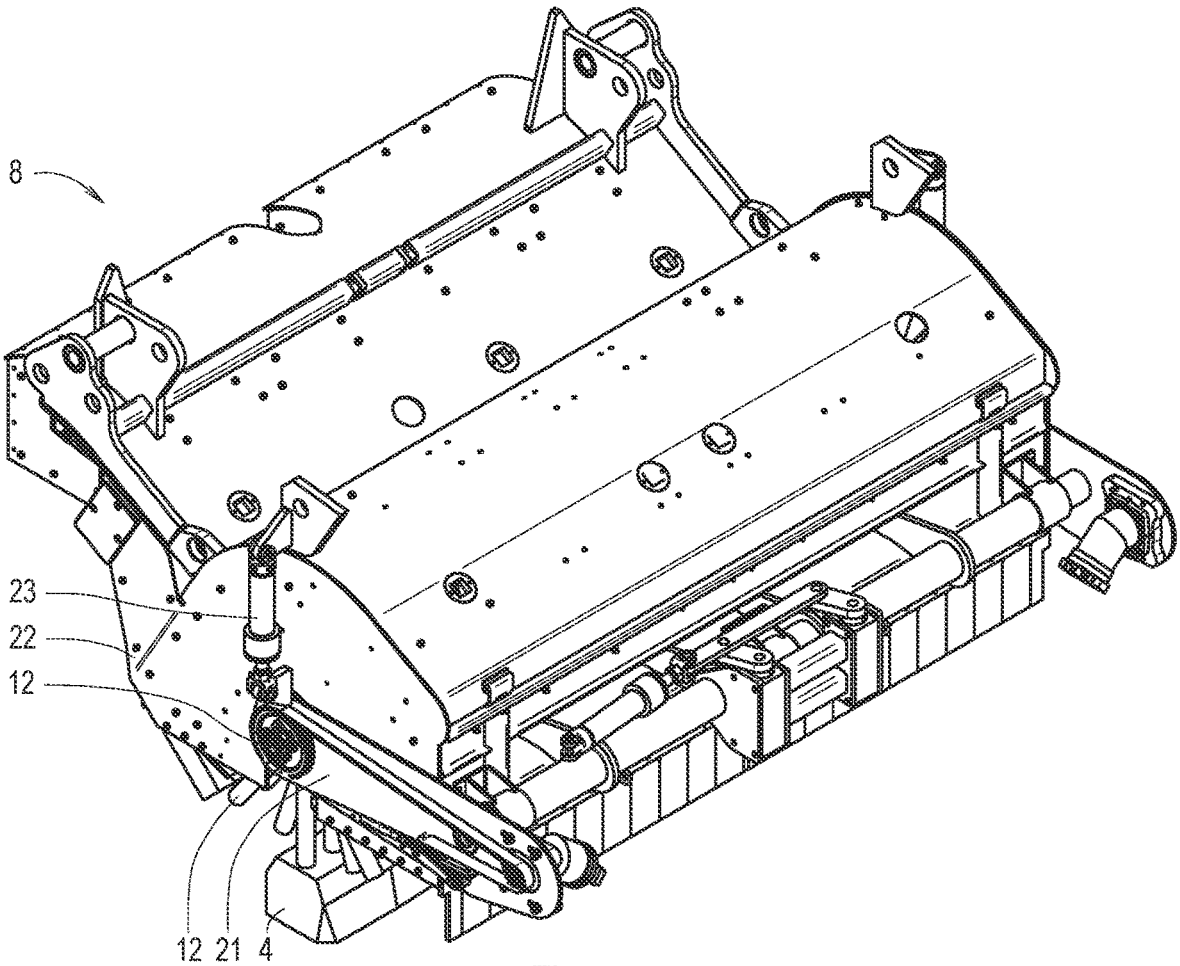

Supplementary to FIG. 6, FIG. 7 shows an isometric drawing of the sweeping device 8 in the brush box 22.

The invention claimed is:

1. A sweeping device for working on a track formed of rails and sleepers, the sweeping device comprising:

a brush shaft having a plurality of shaft portions each configured as a hollow shaft;

resilient sweeping elements protruding radially from said brush shaft;

at least one adjustable vertical drive for attaching the sweeping device to a vehicle that can travel on the rails;

a frame supporting said brush shaft, said at least one adjustable vertical drive is connected to said frame;

a control shaft having control elements, at least one shaft portion of said shaft portions being adjustable about one axis of rotation via said control shaft by said control elements acting externally on said shaft portion.

2. The sweeping device according to claim 1, wherein said control elements are joined to said control shaft being a rotatably mounted control shaft and are configured in a sword-shape.

3. The sweeping device according to claim 1, further comprising:

a mechanical linkage; and at least one gear, said control shaft is rotated via said mechanical linkage and said at least one gear.

4. The sweeping device according to claim 3, wherein said at least one gear is a worm gear.

5. The sweeping device according to claim 1, further comprising cardan joints, individual ones of said shaft portions of said brush shaft are movably connected via said cardan joints.

6. The sweeping device according to claim 1, further comprising at least one laterally disposed chain drive, said brush shaft is driven by means of said at least one laterally disposed chain drive.

7. The sweeping device according to claim 1, wherein said brush shaft has five said shaft portions.

8. The sweeping device according to claim 1, wherein two of said control elements act on a central part of said shaft portions, with one of said control elements each acting on a bearing point on a left and a right of the central part.

9. The sweeping device according to claim 1, further comprising a common brush box, said brush shaft and said control shaft with their associated drive and bearing components are disposed in said common brush box.

10. The sweeping device according to claim 1, wherein said resilient sweeping elements, which are resilient and radially disposed on said brush shaft, are made of solid material or internally hollow, tubular products.

* * * * *